US008413764B1

(12) United States Patent
Cohen et al.

(10) Patent No.: US 8,413,764 B1
(45) Date of Patent: Apr. 9, 2013

(54) LADDER SAFETY DEVICE, SYSTEMS AND METHODS OF ARRESTING FALLS FROM LADDERS

(76) Inventors: David A. Cohen, Briarcliff Manor, NY (US); John P. McCarthy, IV, New York, NY (US)

( * ) Notice: Subject to any disclaimer, the term of this patent is extended or adjusted under 35 U.S.C. 154(b) by 597 days.

(21) Appl. No.: 12/569,334

(22) Filed: Sep. 29, 2009

(51) Int. Cl.
*E06C 7/18* (2006.01)

(52) U.S. Cl.
USPC ..... 182/63.1; 182/62.5; 182/64.1; 182/65.1; 182/66.1; 182/66.2; 182/69.4

(58) Field of Classification Search ..... 182/62.5, 182/63.1, 64.1, 65.1, 66.1, 66.2, 69.4
See application file for complete search history.

(56) References Cited

U.S. PATENT DOCUMENTS

| | | | | | |
|---|---|---|---|---|---|
| 197,324 | A | * | 11/1877 | Boynton | 182/66.1 |
| 202,263 | A | * | 4/1878 | James | 182/68.1 |
| 535,346 | A | | 3/1895 | Berkman | |
| 1,285,918 | A | | 11/1918 | Brown | |
| 1,373,133 | A | | 3/1921 | Huff | |
| 1,450,694 | A | | 4/1923 | Mahoney | |
| 1,465,182 | A | * | 8/1923 | Sago | 182/41 |
| 1,531,982 | A | * | 3/1925 | Sago | 182/41 |
| 2,074,557 | A | * | 3/1937 | Pirsch | 182/66.2 |
| 2,198,071 | A | * | 4/1940 | Artini | 182/103 |
| 2,248,794 | A | | 7/1941 | Troche | |
| 2,376,875 | A | * | 5/1945 | Honig | 182/66.2 |
| 2,538,904 | A | | 1/1951 | Herod | |
| 2,551,036 | A | * | 5/1951 | Mills | 446/315 |
| 2,553,438 | A | | 5/1951 | Caduff et al. | |
| 2,616,609 | A | | 11/1952 | Herod | |
| 2,841,960 | A | * | 7/1958 | Holan et al. | 91/529 |
| 2,886,227 | A | | 5/1959 | Rose et al. | |
| 2,946,396 | A | | 7/1960 | McDougal | |
| 3,044,572 | A | | 7/1962 | Thomas et al. | |
| 3,417,840 | A | | 12/1968 | Farnsworth, Jr. | |
| 3,674,116 | A | | 7/1972 | Vogeli | |
| 3,768,123 | A | | 10/1973 | Forte | |
| 3,902,569 | A | | 9/1975 | Bair | |
| 3,948,362 | A | | 4/1976 | Greest | |
| 3,966,018 | A | * | 6/1976 | Kozai et al. | 182/103 |
| 3,979,797 | A | | 9/1976 | Stember | |
| 4,059,871 | A | | 11/1977 | Swager | |
| 4,085,818 | A | | 4/1978 | Swager | |
| 4,111,280 | A | | 9/1978 | Devine et al. | |
| RE30,072 | E | | 8/1979 | Kleine et al. | |
| 4,184,568 | A | | 1/1980 | Hillier | |
| 4,252,214 | A | | 2/1981 | Miller | |
| 4,352,409 | A | | 10/1982 | Fountain | |
| 4,379,498 | A | | 4/1983 | Krusmark | |
| 4,396,093 | A | * | 8/1983 | Zimmerman | 182/208 |
| 4,401,183 | A | | 8/1983 | Schler | |
| 4,406,350 | A | | 9/1983 | Smith | |
| 4,423,796 | A | | 1/1984 | Sulowski et al. | |
| 4,521,000 | A | | 6/1985 | Dodge, Jr. | |

(Continued)

*Primary Examiner* — Katherine Mitchell
*Assistant Examiner* — Colleen M Chavchavadze
(74) *Attorney, Agent, or Firm* — Hoffmann & Baron, LLP

(57) ABSTRACT

A ladder safety device, systems and methods of arresting falls from ladders are provided. The ladder safety device includes a safety guide that extends along the length of an extension ladder. The length of the guide along the length of the ladder extends and contracts in unison with the extension and retraction of the extension ladder, and a tension is maintained on the guide to maintain a load during use of the ladder for climbing.

18 Claims, 5 Drawing Sheets

U.S. PATENT DOCUMENTS 4,550,804 A 11/1985 Bummer
4,770,272 A 9/1988 Riley
4,875,547 A * 10/1989 Hanthorn ..... 182/102
5,035,299 A 7/1991 Eisenberg
5,056,619 A 10/1991 Darnell et al.
5,090,503 A 2/1992 Bell
5,161,639 A * 11/1992 Ice ..... 182/8
5,238,084 A 8/1993 Swager
5,265,696 A 11/1993 Casebolt
5,429,289 A 7/1995 Lamson et al.
5,628,381 A 5/1997 Markovich et al.
5,638,916 A 6/1997 Schneider
5,671,822 A 9/1997 Phillips
5,816,362 A 10/1998 Jenkins, Jr.
5,855,252 A 1/1999 Vrolyks
5,875,867 A 3/1999 Beard
5,931,258 A 8/1999 Lorentz
5,970,517 A 10/1999 Jordan
6,016,890 A 1/2000 Whitmer
6,161,647 A 12/2000 Braden et al.
6,167,988 B1 1/2001 Frodge et al.
6,189,654 B1 2/2001 Bailey et al.
6,298,945 B1 10/2001 Anders et al.
6,374,945 B1 4/2002 Sherwood
6,474,442 B1 11/2002 Atkinson et al.
6,488,118 B1 12/2002 Corriveau
6,571,912 B2 6/2003 Soll
6,805,220 B2 10/2004 Fulton et al.
6,837,337 B2 1/2005 Thomas et al.
6,854,562 B2 2/2005 Kwak
6,874,596 B2 4/2005 Zeissler et al.
6,929,093 B1 8/2005 Land
7,014,594 B2 3/2006 Stoltz
7,025,174 B1 4/2006 Hawley
7,219,766 B2 5/2007 Deuer
7,987,945 B2 * 8/2011 Petersen ..... 182/8
2002/0014370 A1 2/2002 Casebolt et al.
2006/0169864 A1 8/2006 Salerno
2007/0158137 A1 7/2007 Peterson
2007/0193824 A1 8/2007 Anderson
2008/0000721 A1 1/2008 Deal

* cited by examiner

LADDER SAFETY DEVICE, SYSTEMS AND METHODS OF ARRESTING FALLS FROM LADDERS

FIELD OF THE INVENTION

The present invention relates generally to safety devices for ladders, and systems and methods of preventing or slowing ("arresting") falls from ladders. More specifically, the present invention is concerned with safety devices, systems and methods for telescoping/extension ladders and/or aerial ladders (referred to generally herein as "ladder" or "ladders"), including but not limited to safety devices, systems and methods for ladders mounted to a turntable or a fixed point of a fire truck.

BACKGROUND OF THE INVENTION

Each year in the United States and its protectorates, approximately 100 firefighters are killed while on duty, and tens of thousands more are injured. Many of the deaths and injuries are related to firefighters engaged in aerial and ladder operations on a fire truck (often referred to as a "ladder truck", "ladder truck fire engine", "fire engine", or other similar moniker) as they are ascending and/or descending on the ladder of the truck. Such ladders are often as much as 100 feet long, and in the case of aerials, are supported entirely at their base (as opposed to a traditional "extension ladder" which leans against a structure such as a building). A firefighter ascending or descending an aerial ladder or other ladder is typically wearing 70-80 pounds of equipment and carrying a firefighter tool in one hand such as an axe. This makes the ladder work difficult and extremely dangerous. Adding to the ladder work difficulty, a firefighter is typically wearing standard issue bulky boots that are not custom fit to the foot and gloves that do not have grips to grab the ladder. Compounding the situation of ascending or descending on a ladder even further, is the vertical nature of the ladder itself, and the natural elements that must be faced during aerial operations including rain, ice, darkness, heat from a fire and the like. When working in darkness, there is no lighting on the rungs of the ladder. In addition, occasionally there may not be rung alignment between sections of a ladder, increasing the potential for a firefighter to misstep. Furthermore, ladders typically thin out toward the top of the ladder, and the width of the ladder is also decreased because of instruments such as stretchers, etc. stored on the sides of the ladder. This makes it even more difficult for a firefighter to grab the sides of the ladder while climbing. Also, a firefighter may be involved in a rescue operation and carrying a person or body on themselves upon descending down the ladder. An inadvertent slip can easily result in a fall from the ladder and may cost the firefighter his or her life, or result in grave injury.

A few real-life examples of such falls are discussed below, with the names of the firefighters removed to protect their identities.

Example 1

Mr. F was at a fire in a largely abandoned clock factory when he fell from a fully extended aerial ladder 25 feet to the concrete below, landing on his left shoulder. He hit the ground and bounced up like a rubber ball. He separated his shoulder and was out for two and a half months, but miraculously lived to fight fires another day. If he had fallen at a slightly different angle, he likely would have been paralyzed or even killed.

Although the firefighter in this example fully recovered with relatively minor injuries, this type of fall is more often catastrophic.

Example 2

A firefighter fell from the top of an aerial ladder and died when he was trying to reach the roof of a fire building. He was carrying too much equipment and was attempting to get off the aerial ladder at the wrong location.

Example 3

A 22 year old female firefighter trainee fell 28 feet from a cat ladder to the concrete on the second day of her initial training at the Fire Training Academy. She was climbing a cat ladder on a training tower in full turnout gear (i.e. jumpsuit, firehood, socks, boots, turnout coat and pants, helmet, gloves, and a spanner belt around her waist from which hung a fire axe) late in the afternoon near the end of the second full day of training No water was being used in the training, therefore all surfaces were dry. The weather was partly cloudy, humid and 67 degrees at the time of the incident. The police report indicates that witnesses saw the victim stop and put her arms around the ladder, then fall backward off the ladder, head and shoulder hitting the concrete below. No one heard the victim say anything prior to, or during, the fall. The victim was not carrying anything during the climb.

Although numerous safety devices for ladder climbers are known, such devices typically are not practical for use in connection with the portable, telescoping/extension and/or aerial type ladders used by firefighters. For example, U.S. Pat. No. 3,979,797 discloses a safety clamp on a workman's belt that is slidably engaged with a cable or rod that is in proximity to a ladder affixed to a structure such as a stack, tank or tower. Similarly, U.S. Pat. No. 5,265,696 discloses a ladder climbing safety clamp that cooperates with a cable or rod that, along with the ladder, is affixed to a structure. Both of these devices are fixed-length structures that are connected to the building being climbed. Making such a connection is time consuming, and typically not possible to accomplish during a fire. Moreover, the height of the ladders and the safety cables of the two above-described devices are a constant length. The above-described safety devices do not work with ladders of varying length such as the telescoping/extension and/or aerial ladders used by firefighters.

U.S. Pat. No. 4,252,214 discloses a device wherein a long stroke single action fluid cylinder is used in connection with a system of pulleys on an oil derrick to control the length of a safety line attached to a climber. The length of the line in that device corresponds to the height of a single climber. Such a device is not suitable for use in connection with a ladder used by firefighters, on which several firefighters will often climb at once. Moreover, the height of the ladder and the safety cable of the above-described device are a constant length. The above-described safety device does not work with ladders of varying length such as the telescoping/extension and/or aerial ladders used by firefighters.

While all of the prior art devices described above may be useful to protect the safety of a ladder climber in certain controlled situations, it is desirable to provide a safety device suitable for use with telescoping/extension and/or aerial ladders, such as those mounted to fire trucks.

A specialized ladder truck apparatus that is often utilized by firefighters to allow the firefighters and/or casualties to gain access or egress at height, provide a high-level water point for firefighting, and provide a working platform (in some cases) from which firefighters can perform tasks, is known as a Turntable Ladder ("TL"). The name is derived from the fact that the large, usually telescopic, ladder is mounted on a turntable on the front or back of the truck. The turntable allows the ladder to pivot around a stable base, which in turn allows for a much greater ladder length to be utilized safely. Often a TL will include a bucket or other working platform at the top of the ladder, while another TL apparatus that is often utilized by firefighters and which does not include any type of working platform is known as a stick ladder. A stick ladder is an aerial ladder that extends from a fixed location, or from a turntable, on a fire truck. The typical stick ladder is similar to the TL ladder, except it does not include a bucket or platform at the top of the ladder. These are but a few of the several variations of ladders used on fire trucks.

In large cities, urban environments and even more rural areas with houses and other buildings higher than one story, telescoping/extension and/or aerial ladders have been proven very useful in transporting equipment, rescuing occupants, fighting fires, accessing the roof of a building, ventilating a building and providing access to window of burning structures. Although many telescoping/extension and/or aerial ladders contain side rails for fall safety of people climbing up and/or down, such rails still do not eliminate falls and often the rails are not accessible due to gear being stowed on the ladder. As is discussed above, firefighters typically are wearing a lot of large bulking protective gear, including large gloves and boots, which make it difficult to gain good traction and grip on the ladder. In addition, the typical firefighter helmet is large and heavy and makes it difficult to move the head around. Moreover, firefighters often may be tired, injured and/or under considerable stress, depending upon the specific situation, as they are ascending/descending the ladder. Adding even more difficulty, firefighters often are carrying additional equipment up or down the ladders as they climb, leaving them with only one hand to grasp the rungs. The ladder is often swaying back and forth, often is wet from the water used to fight the fire, and in the case of low temperatures, ice may be present making the ladder slippery. As a firefighter transitions in his/her climb from one extension to another, there is even greater opportunity to miss footing the rung securely. In addition, the more severe the angle of the ladder (i.e. the more vertical the ladder's position), the less the side rails serve to arrest any type of fall. Also, a firefighter may be involved in a rescue operation and carrying a person or body on themselves upon descending down the ladder. Therefore, it is desirable to provide a ladder safety device, systems and methods that arrest falls in all situations encountered by firefighters and other ladder climbers.

To better equip firefighters to climb safely in spite of all the above-described hazards, many firefighters go through a variety of training and conditioning exercises. Nevertheless, as is discussed above, a mere slip can quickly result in a catastrophic outcome, even during a training exercise. Moreover, it is estimated that 87% of fire departments in the U.S., protecting 38% of the population, are made up of volunteer or mostly volunteer fire fighters. Such volunteers, or "part-time" fire fighters are often even more susceptible to slip and fall from a ladder due to less training and experience on ladder operations. No matter the level of experience or training of firefighter or climber, a single slip can easily occur and in such case a resulting fall can be catastrophic. Therefore, it is desirable to provide a ladder safety device, systems and methods that arrest falls in all situations encountered by firefighters and other ladder climbers regardless of a climber's training or experience.

SUMMARY OF THE INVENTION

An object of the instant invention is to provide ladder safety devices, systems and/or methods of arresting falls from ladders. Another object of the invention is to provide ladder safety devices, systems and/or methods of arresting falls from ladders suitable for use with telescoping/extension and/or aerial ladders, such as those mounted to fire trucks. Yet another object of the instant invention is to provide ladder safety devices, systems and/or methods of arresting falls in virtually any and all situations encountered by firefighters and other ladder climbers. Still another object of the invention is to provide ladder safety devices, systems and/or methods of arresting falls in virtually any and all situations encountered by firefighters and other ladder climbers regardless of a climber's training or experience. Another object of the invention is to provide ladder safety devices, systems and/or methods of arresting falls from ladders that can be utilized or retrofit onto existing firefighting apparatuses and/or that can be used on newly manufactured equipment.

The above-described objects, and other objects that will become apparent to a person of ordinary skill in the art upon learning of the instant invention, are accomplished through the use of a safety guide-wire, rail or other suitable guide for a cable grab or other suitable grab device, that extends along the length of an extension ladder. The length of the guide along the length of the ladder extends and contracts in unison with the extension and retraction of the telescoping/extension and/or aerial ladder, and a level of tension sufficient to arrest the fall of one or more climber(s) is maintained on the guide during use of the ladder for ascending or descending. In one preferred embodiment, the level of tension is generally constant.

In several embodiments of the instant invention a guide-wire (or rope, strap, or other suitable material) is wound around a spool that is mounted at a first location on or near either the top or bottom ends of the extension ladder. In several embodiments in which the guide-wire is wound around a spool, the spool is connected to an electrical motor and a control system for controlling the winding and unwinding of the guide-wire about the spool. In another embodiment, the spool is self-winding with spring or other suitable mechanism, without the use of any motor, to cause the spool to rewind as the ladder is retracted. In one embodiment in which the spool is connected to an electrical motor and control system, the control system for the electrical motor is associated with an electrical control system (and associated mechanical components) utilized to extend and retract the ladder. The electrical motor is controlled to operate in a first direction to unwind the guide-wire from the spool as the ladder is extended, and is controlled to operate in a second opposite direction to wind the guide-wire back around the spool as the ladder is retracted. In a preferred embodiment, the motor is controlled in unison with the extension/retraction of the ladder such that the length of guide-wire that is either unwound or wound is generally equal to the length of extension or retraction of the ladder. When the ladder is extended or retracted to its desired position, and the control system is no longer being utilized to position the ladder, in a preferred embodiment an electrically or mechanically (such as a spring or other suitable device) activated brake associated with the motor and/or spool is automatically applied by the control system to lock the length of the guide-wire and hold general tension in the guide-wire sufficient in the case of a fall event or loading situation while the guide-wire is being used. When the control system is again utilized to position the ladder, the brake is deactivated automatically by the control system prior to extension or refraction of the ladder. In another preferred embodiment, a manual brake associated with the motor and/or spool is applied by a user operating the ladder controls to maintain cable tension, lock the cable length, and/or to prevent operation of the ladder controls while the manual brake is applied. In one embodiment, the manual brake is electrical, or electromechanical. In another embodiment, the manual brake is mechanical. In still another preferred embodiment, the manual brake is utilized in combination with the automatic brake. In another preferred embodiment, a mechanical safety back-up brake is associated with the motor and/or spool in the event of a failure of the automatic and/or manual brakes discussed above. The back-up brake engages when the guide-wire is unwound at a rate that is faster than an acceptable rate used to position the ladder.

In another embodiment in which a guide-wire is wound around a spool, the spool is tensioned by an internally wound rotational spring. As the ladder is extended, the spring is unwound as the spool unwinds to let out the guide-wire. As the ladder is retracted, the spring winds back up and winds the guide-wire back around the spool. In preferred embodiments, an electrical control system (and associated mechanical components) is used to control the extension and retraction of the ladder. In one such embodiment, when the control system is no longer being utilized to position the ladder, an electrically or mechanically activated brake associated with the motor and/or spool is automatically applied by the control system to maintain a generally constant tension on the guide-wire and to lock the guide-wire length during usage. When the control system is again utilized to position the ladder, the brake is deactivated automatically by the control system prior to extension or retraction of the ladder. In another preferred embodiment, a manual brake associated with the motor and/or spool is applied by a user operating the ladder controls to maintain cable tension and/or to prevent operation of the ladder controls while the manual brake is applied. In one embodiment, the manual brake is electrical, or electromechanical. In another embodiment, the manual brake is mechanical. In still another preferred embodiment, the manual brake is utilized in combination with the automatic brake. In another preferred embodiment, a mechanical safety back-up brake is associated with the motor and/or spool in the event of failure of automatic and/or manual brakes discussed above. The back-up brake engages when the guide-wire is unwound at a rate that is faster than an acceptable rate used to position the ladder.

In another embodiment, a fixed-length guide-wire (i.e. not wrapped around a spool) is utilized. In several such embodiments, the guide-wire extends along the length of one side of the extension ladder, and wraps around to the opposing side of the ladder through a series of pulleys, mounts or similar lead structures (referred to generally herein as "leads") mounted to each ladder section. In one particular embodiment, the guide-wire extends along the topside length of the extension ladder (i.e. the side of the ladder on which the user climbs), and wraps around to the underside of the ladder through the leads. As the ladder extends, the lead attached to the section that is extending moves outward toward a lead mounted on the section of ladder from which the extending section is extending. This results in the distance between the two leads to decrease as the ladder is extending, causing the length of guide-wire along the topside length of the extension ladder to increase generally an equal amount to the length the ladder is extended. As the ladder is retracted, the leads move away from each other, causing the length of the guide-wire along the topside length of the extension ladder to decrease an amount generally equal to the length the ladder is retracted.

In another embodiment, a fixed length guide rail is attached along the length of each section of an extendable ladder. The guide rail may be attached at several points along the length of the ladder, or alternatively, may be integrally formed into the side rail (or other portion) of the ladder. In a preferred embodiment, the guide rail from one section includes an intersection portion that curves over to and/or merges into the guide rail of the adjoining section of the extension ladder. The guide rail and intersection sections work similar to a train track intersection routing a grab device from an outside rail to an inside rail (or vice versa) at the intersection section. In another preferred embodiment, each guide rail includes a knob somewhere on the rail to prevent a grab device from accidentally disengaging the rail in the event that a user clips onto the wrong part of the rail or there is a malfunction. It will be appreciated that the rail of the instant invention may include a solid extruded body, or a multiple section linkage (such as a chain) of virtually any cross-sectional profile to allow a grab device to glide along the rail.

In another embodiment of the instant invention, a combination of the spool discussed in several embodiments above, is combined with the lead system in which a length of guide-wire extends along one side of the ladder and wraps around to the other side. The combination of the spool and lead system allows (i) a shorter length of guide-wire to be stored on the spool than in the embodiments that only utilized a spool, (ii) increased reliability and (iii) increased flexibility in design and usage of the system.

Some preferred embodiments of the invention described above are utilized in connection with a Turntable Ladder mounted to a turntable of a fire truck. Nevertheless, it will be appreciated that the embodiments of the invention described above may be utilized in connection with any telescoping, extension, aerial or other ladder now known or hereinafter developed, including, but not limited to, any ladders mounted to turntables, mounted to fixed locations or platforms, positioned at unfixed locations, mounted to a truck, ladders used for fire fighting or for any other purpose.

In use, a firefighter, or other ladder climber, wears a ladder belt or other suitable harness with a carabineer or oval loop connected to a cable grab (or other suitable grab) via a lanyard. The climber steps up to the ladder and attaches the cable grab to the guide-wire (rope, rail, etc.). The climber then ascends and descends the ladder as necessary. In the event of a fall, the cable grab will lock and the climber's fall will be arrested. Upon completion of the climb or decent, the climber unhooks the cable grab from the guide-wire.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of the invention may be employed alone, or in combination with other features and subcombinations, without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, one or more detailed embodiments of the present invention are disclosed herein; however, it is to be understood that the disclosed embodiments are merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
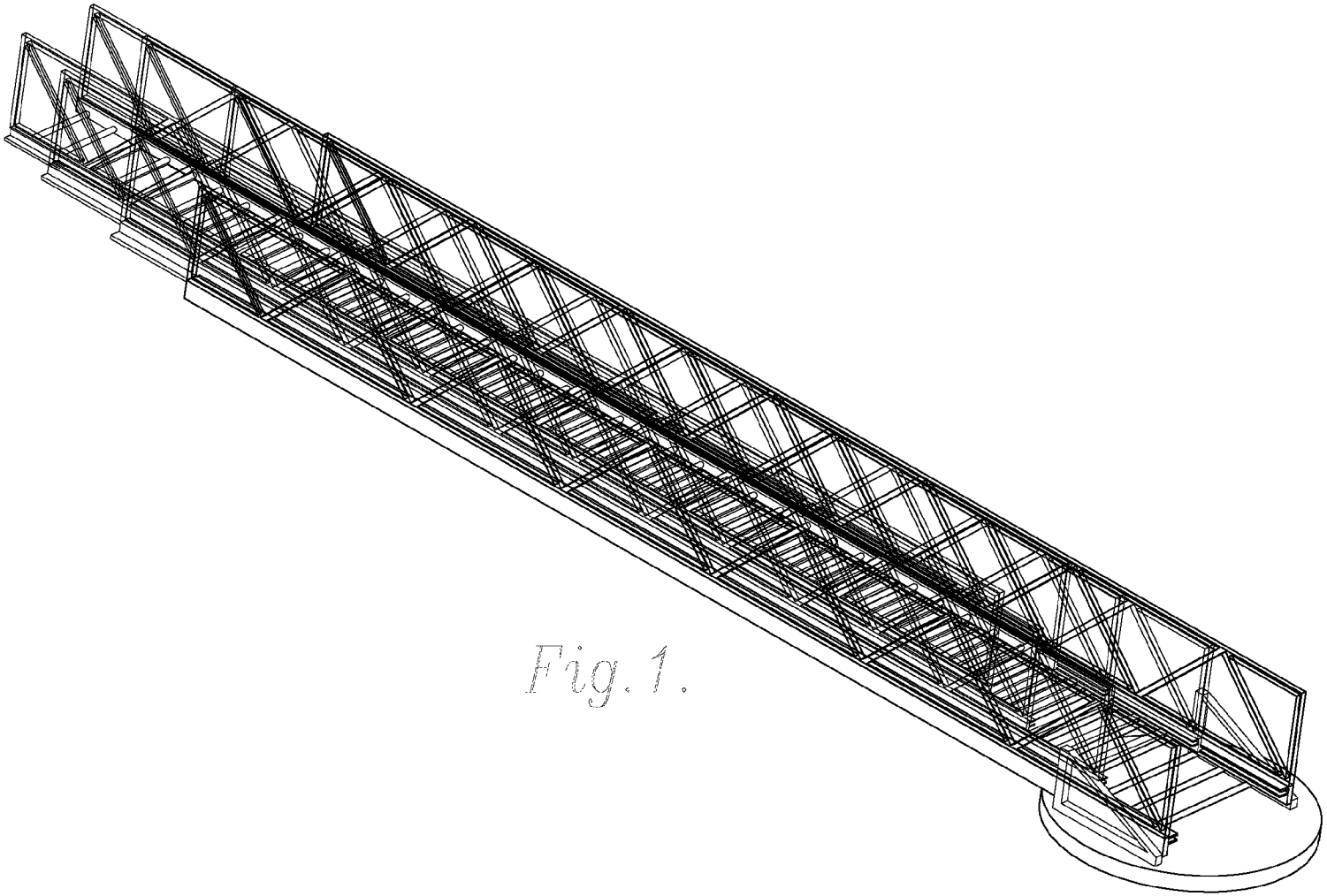
FIG. 1 is a perspective view of a telescoping/extension and/or aerial ladder used in connection with an embodiment of the instant invention.
Figure 2:
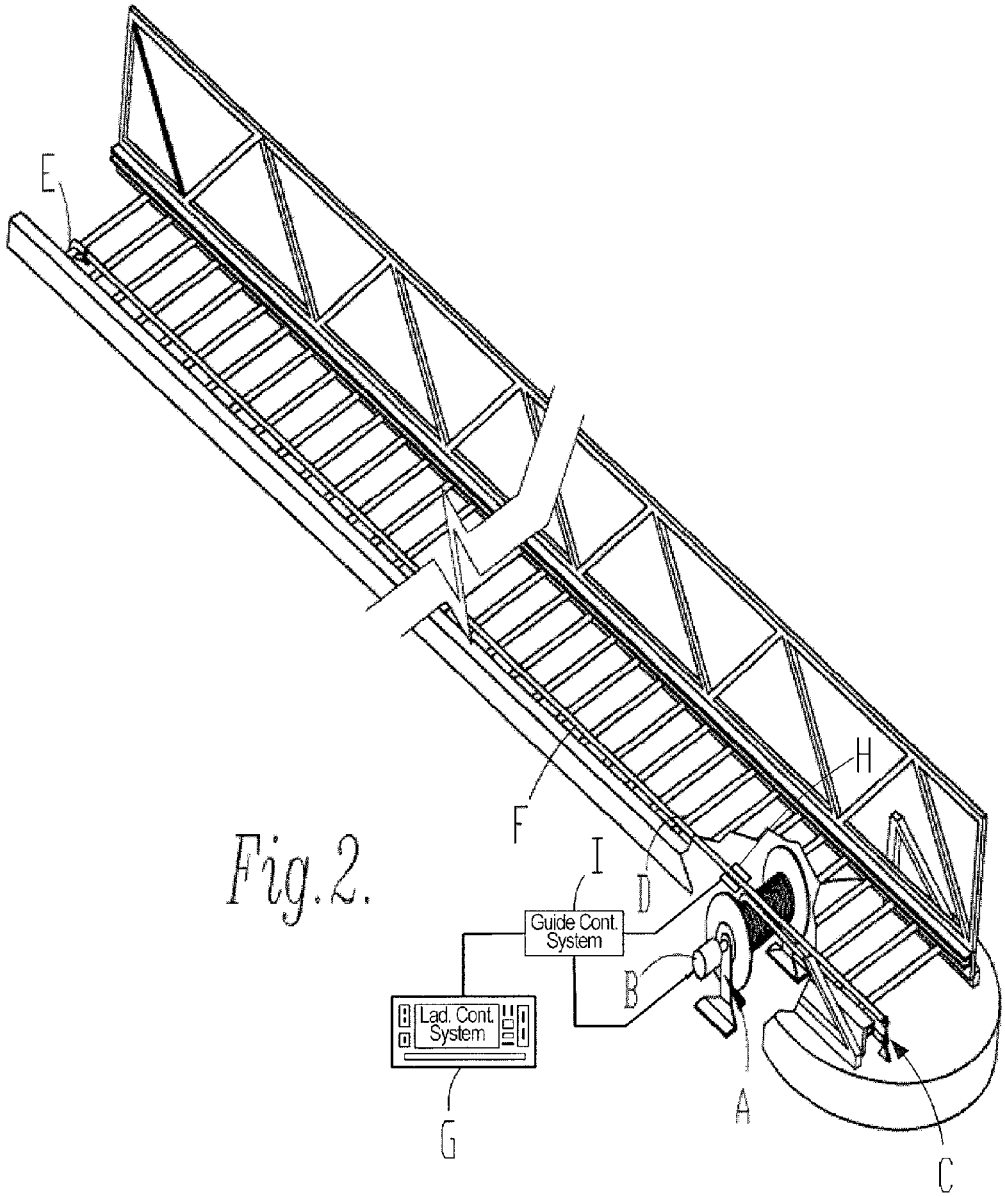
FIG. 2 is a partial, cut-away perspective view of the ladder of FIG. 1 including a ladder safety device of an embodiment of the instant invention.

Referring to FIG. 1 a perspective view of a typical telescoping/extension and/or aerial ladder of the type used in connection with an embodiment of the instant invention is shown. Referring to FIG. 2, a partial cut-away perspective view of the ladder of FIG. 1 is shown in connection with an embodiment of the ladder safety device of the instant invention that includes an electromechanical spool system. The embodiment shown in FIG. 2 is designed to be attached to a Turntable Ladder of a ladder truck fire engine. Nevertheless, it will be appreciated that the ladder can be attached/fixed to another location, attached to a fixed location, or alternatively can be free-standing (unfixed). Furthermore, although not shown in FIG. 1 or 2, it will be appreciated that the ladder may include a bucket or other working platform at the top end of the ladder. Further still, it will be appreciated that although four extension sections are shown in the ladder of FIG. 1, the instant invention may be utilized with a telescoping/extension and/or aerial ladder including any number of extension sections. In FIG. 2, portions of the top and bottom extensions of the ladder of FIG. 1 are shown, with the remaining portion of those extensions and middle extension sections being eliminated for ease of illustration. In addition, the left side rail shown in FIG. 1 is removed from FIG. 2 and the lower portion of the bottom extension section is partially cut-away to better show the components of the instant invention. The electromechanical spool system of the embodiment shown in FIG. 2 includes a spool A containing guide-wire F, electrical motor and controls B which are tied into the ladder controls G of the ladder truck; pulley wheel C (or other suitable lead structure) to redirect guide-wire F up along the topside of extension ladder D, and mounting point E for the guide-wire. Although guide-wire F is shown in FIG. 2 as extending along the topside of ladder D, it will be appreciated that the guide-wire may extend along the top side, underside, or either side of the ladder without departing from the spirit and scope of the instant invention.

In a preferred embodiment, in which the total extended length of the ladder D is 100 feet, the total length of the guide-wire is 110 feet (or approximately 110% of the full extension ability of the ladder). It will be appreciated that additional length of guide-wire may be necessary depending upon the mounting location of spool A with respect to ladder D. The spool A and motor B may be mounted under the ladder, on the side of ladder at the bottom, on the platform or turntable of the firetruck, or at any other suitable location. It will be appreciated that although the spool A and motor B are shown mounted at the bottom end of the ladder D, in alternative embodiments, the spool A and motor B will be mounted at the top end of the ladder (or to a bucket or platform mounted at the top of the ladder), with mounting point E located at the bottom end of the ladder. It will further be appreciated that alternative mounting locations for spool A and motor B and mounting point E will be readily apparent to those of ordinary skill in the art.

In a preferred embodiment, ⅜" Stainless Steel, very flexible aircraft cable 7×19 is utilized for the guide-wire. Nevertheless, it will be appreciated that other suitable materials may be utilized without departing from the spirit and scope of the instant invention, including, but not limited to, rope and straps. Specifically, as used herein, the term "wire" is intended to include, wire, cable, rope, straps, or any other suitable material.

The pulley wheel C is used to redirect the angle of the guide-wire F at the bottom of the ladder. It will be appreciated that pulley wheel C may be eliminated in embodiments in which spool A is located appropriately so as to not require redirection of the angle of guide-wire F, or otherwise may be mounted on the side or other location, or multiple pulley wheels may be used in multiple locations.

As is shown in FIG. 2, mounting point E is a fixed-point mount (or a separate brace structure) such as a cable stud. Alternatively, mounting point E may be a pass-through lead or pulley mount with a fixed-point mount at a different location, or other suitable anchor device or anchor/lead combination now known or hereinafter developed. It will be appreciated that the guide-wire F may be mounted to either the top rung, the side of the ladder, to a platform or bucket (if applicable), or to any other suitable location, either through a fixed-point mount, pulley (or lead) or other suitable mount, or through an anchor/lead combination. Furthermore, it will be appreciated that a separate feed of guide-wire may extend from mounting point E to a platform or base.

In a preferred embodiment, the ladder controls G that control the position (including extension and retraction) of the ladder D are tied to the controls I of electrical motor B. It will be appreciated that the ladder controls may be separate from the motor controls (such as for retro-fit applications), or alternatively, an integrated controller may be utilized. As the ladder is extended or retracted, the motor control system for motor B attempts to automatically keep a constant tension on the guide-wire F by extending or retracting the guide-wire in unison with the extension or retraction of the ladder. In one embodiment, this is accomplished by a feedback control loop in which the control system for the motor monitors the output of the ladder controls and activates motor B accordingly depending upon when the ladder is being extended or retracted. When the ladder positioning is finished, a signal is sent automatically by the ladder controller to the motor control system (or the motor control system determines positioning is finished based upon the output of the ladder controller), and an electrically and/or mechanically activated brake H is applied to the motor or spool to maintain the tension in the cable.

In a preferred embodiment, the ladder operator also has the option of electrically or mechanically activating a manual brake to keep the cable tensioned. If the manual brake is applied by the ladder operator through use of the ladder controls, a signal will be sent from the control system to apply the brake. If a separate controller is used to control the ladder position instead of a single control to control both the motor and the ladder position (i.e. in a retrofit application), in a preferred embodiment the motor controller sends a signal to (or otherwise disables operation of) the ladder control system to keep it from operating until the manual brake is released.

In the event of the electromechanical and manual brake failures, in a preferred embodiment of the invention the spool A includes a safety back-up brake that engages if the guide-wire is pulled out faster than an acceptable rate used to position the ladder.

In the embodiment of the invention described above, the firefighter wears a ladder belt or other suitable and approved harness with a carabineer, oval loop or other similar devices now known or hereinafter developed. A shock-absorbing, or non-shock absorbing lanyard (depending upon system design and/or user preferences) approximately 2 to 4 feet in length is connected from the carabineer, oval loop or other similar device to a cable grab. In the preferred embodiment discussed above, the cable grab is suitable for ⅜ inch cable and rated for vertical and non-vertical use. Nevertheless, alternative cable diameters and/or other materials such as rope, straps, etc., may be utilized without departing from the spirit and scope of the instant invention. In operation, the firefighter steps up to the ladder, attaches the lanyard to his ladder belt or safety harness, attaches the cable grab (or other similar device for arresting a climber's fall) to the lanyard, and then hooks the cable grab onto the guide-wire F. The firefighter can then ascend and descend the ladder as necessary. In the event of a fall, the cable grab locks and the firefighter's fall is arrested. Upon completion of the climb or decent, the firefighter unhooks the cable grab.

In an alternative embodiment to that shown in FIG. 2, motor B is replaced with a rotational spring that is connected to spool A. The guide-wire is wound around a spool and the spool is tensioned by the internally wound rotational spring. As the ladder is extended, the spring is unwound as the spool unwinds to let out the guide-wire. As the ladder is retracted, the spring winds back up and winds the guide-wire back around the spool. The control of the ladder extension, braking systems, and climbing procedure are the same or similar to those described above with respect to FIG. 1.

Figure 3:
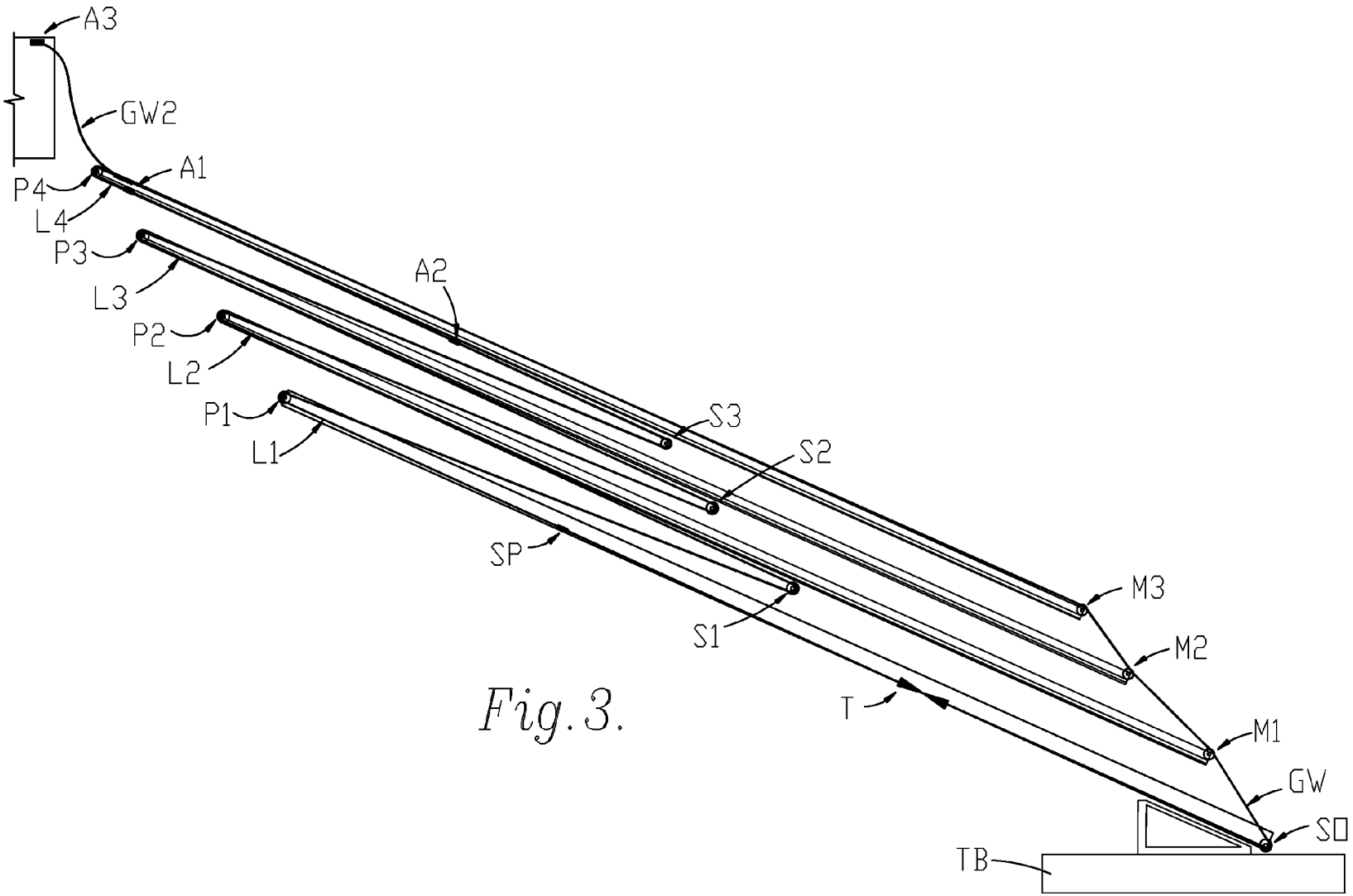
FIG. 3 is a side view of a telescoping/extension and/or aerial ladder including a ladder safety device of another embodiment of the instant invention.

Referring to FIG. 3 a fixed-length guide-wire (i.e. not wrapped around a spool) embodiment of the instant invention is shown. The fixed-length wire system of the invention shown in FIG. 3 includes ladder sections L1 through L4. Nevertheless, it will be appreciated that any number of sections (i.e. 2, 3, 5, 10, etc.) may be utilized without departing from the spirit and scope of the instant invention. L1 is the base or bottom section of the ladder shown in FIG. 3, and L4 is the top section. Base section L1 is mounted to turntable base TB of a ladder truck fire engine.

Pulley wheels, or other suitable lead structures, S0 through S3 are mounted under each section of the ladder, generally towards the bottom end of each section. Pulley wheels S0 through S3 are used to redirect the feed of guide-wire GW along the underside of the sections of the ladder. S0 is mounted under L1; S1 is mounted under L2; S2 is mounted under L3; and S3 is mounted under L4. Pulley wheels, or other suitable lead structures, P1 through P4 are mounted at the top of each ladder section to further redirect the feed of guide-wire GW. Although guide-wire GW is shown in FIG. 3 as extending along the topside and undersides of the ladder sections, it will be appreciated that alternative arrangements and/or positions for the guide-wire may be utilized without departing from the spirit and scope of the instant invention.

The guide-wire GW is anchored to ladder section L4 at anchor points A1 and A2 for anchoring each end of guide-wire GW. It will be appreciated that alternative and/or additional anchor points may be utilized, including anchor points on differing ladder sections, without departing from the spirit and scope of the instant invention. Nevertheless, it will further be appreciated that anchor points A1 and A2 should be positioned relatively close together for the system of the instant invention to work most efficiently. In addition, it will be appreciated that a continuous loop of guide-wire may be utilized in which a single anchor point is utilized instead of two anchor points.

As is shown in FIG. 3, a bucket/platform is attached to the top end of ladder section L4. Nevertheless, it will be appreciated that the embodiment of the invention shown in FIG. 3 may also be used in connection with a stick ladder. In the particular embodiment shown in FIG. 3, an additional length or feed of guide-wire GW2 extends from the top of section L4 to the bucket/platform (or other stable part of the ladder or apparatus). In a preferred embodiment, a transition mount or lead is located at the end of the additional feed of guide-wire mounted to the top of L4 such that a cable grab can easily transition from the ladder portion of the guide-wire (GW) to the feed (GW2) going to the platform/bucket. In a preferred embodiment, the feed (GW2) of guide-wire extending from L4 to the platform/bucket has slack in it to accommodate changes in angle and distance as the platform levels itself at different ladder angles. It will be appreciated that in alternative embodiments where no bucket or platform is included (such as a stick ladder), a length of guide-wire GW may extend from L4 to a side mount or other suitable mount.

The guide-wire GW is fixed at point A1 and loops above P4, down the length of L4, all the way straight to the base of L1. At this point, guide-wire GW wraps around pulley S0 to the underside of L1. At the underside of L1, in line with the guide-wire GW, is a turnbuckle T. This turnbuckle T is used to adjust the total length of the guide-wire by a few feet for fitting purposes. In line with the turnbuckle is a spring device SP that is used to keep constant tension on the guide-wire throughout the range of telescoping of the ladder extensions. In a preferred embodiment, inline with the spring SP also is a device (e.g., tension meter) to determine/measure how much tension is in the guide-wire. This measurement is electronically fed back to the control panel of the ladder to signal to the operator that everything is functioning as planned and/or that an error/trouble condition exists. It will be appreciated that the tension meter may be mechanical, electrical or other suitable measurement device. Furthermore, it will be appreciated that the tension meter may be attached to the spool or otherwise separate from the guide-wire. It will be appreciated that in alternative embodiments, the turnbuckle, spring, or other suitable devices may or may not be used.

The guide-wire continues up the underside of segment L1 and around pulley P1, down the ladder and is redirected up the underside of L2 via pulley S1. The guide-wire continues up the underside of segment L2 and around pulley P2, down the ladder and is redirected up the underside of L3 via pulley S2. The guide-wire continues up the underside of segment L3 and around pulley P3, down the ladder and is redirected up the underside of L4 via pulley S3 until reaching anchor point A2 near the original anchor point A1.

In this configuration, the guide-wire is a constant length and tension at all times. The spring device serves to adjust for any angle differences as the ladder extends and retracts. As the ladder extends and retracts, the S pulleys and the P pulleys close the distance (i.e. the distance between S1 and P1 decreases, the distance between S2 and P2 decreases, and the distance between S3 and P3 decreases), and the extra guide-wire is fed out to the topside length of the ladder. During retractions, the S and P pulleys move further apart (i.e. the distance between S1 and P1 increases, the distance between S2 and P2 increases, and the distance between S3 and P3 increases) and "pull in" the guide-wire to the underside of the ladder.

This system is very reliable and not easily prone to any mechanical or electrical failures.

The firefighter or other climber uses the system in the same way or similar way as described above with previous embodiments. The firefighter steps up to the base of L1, clips into the guide-wire with his wire-grab, and then starts ascending. Upon reaching either the top or bottom, the firefighter unclips and goes about his/her business.

As in shown in FIG. 3 the guide-wire includes mounts M1-M3 along the topside length of the guide-wire, that serve to limit deflection of the guide-wire should a firefighter or climber fall event occur. In this manner, if a climber falls, it is less likely to knock another climber off on a different section of the ladder. Mounts M1-M3 are eye-hooks, tubes, open pulleys, or any other suitable structure that allows guide-wire GW to move there through while at the same time limiting deflection of the guide-wire. In a preferred embodiments, the structure of mounts M1-M3 that are utilized are selected such that the cable grab used by climbers can easily ride over, through or under the mounts. Although shown in connection with the embodiment shown and described in FIG. 2, it will be appreciated that the same or similar mounts may be utilized in connection with any embodiment of the instant invention. Furthermore, it will be appreciated that additional mounts, or less mounts, as desired, may be utilized without departing from the spirit and scope of the instant invention.

Figures 4, 5, 6, 7:
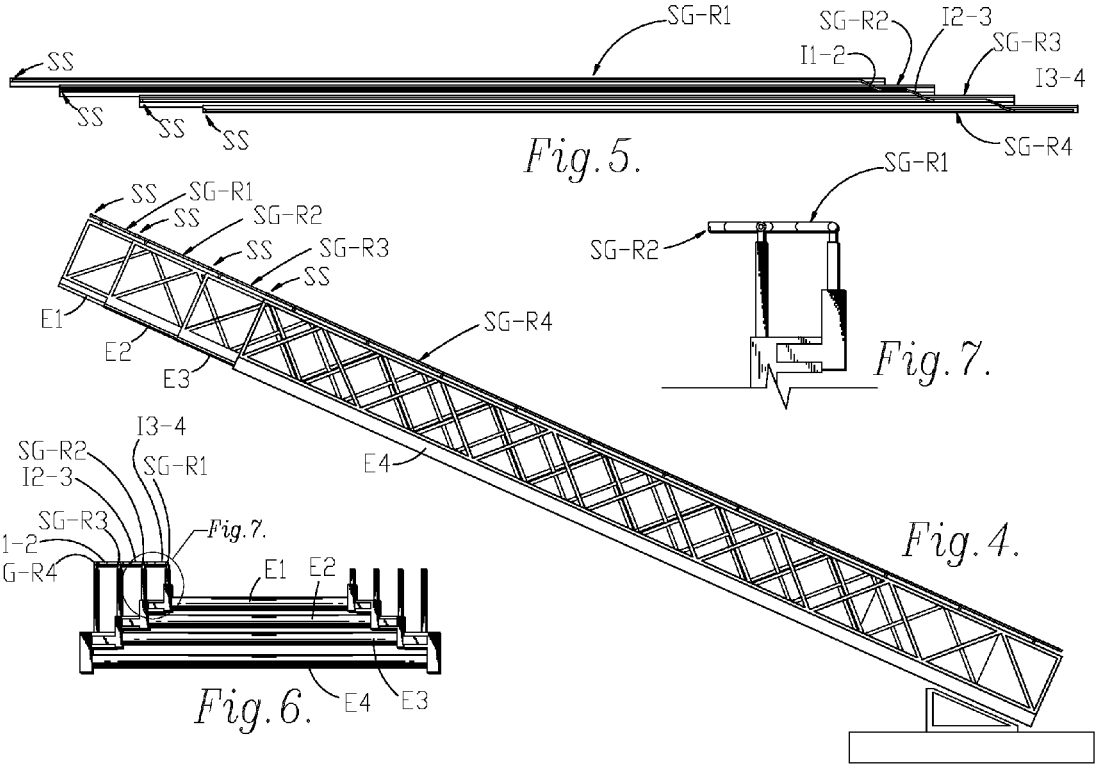
FIG. 4 is a side view of a telescoping/extension and/or aerial ladder including a ladder safety device of another embodiment of the instant invention.
FIG. 5 is a partial topside view of the side rails of one side of the ladder of FIG. 4.
FIG. 6 is a partial bottom end view of the ladder of FIG. 4.
FIG. 7 is a detailed bottom end view of the ladder of FIG. 6 showing the rail profile.

Referring to FIGS. 4 through 7 a fixed length guide rail system of the instant invention is shown. In the embodiment shown in FIGS. 4 through 7 though a guide rail is attached along the length of one side rail of each section of an extendable ladder, the guide rail may be attached at several points along the length of the ladder, or alternatively, may be integrally formed into the side rail (or other portion) of the ladder. Furthermore, although FIGS. 4 through 7 show a ladder including four extension sections (E1, E2, E3 and E4), it will be appreciated that any number of ladder extension sections may be utilized without departing from the spirit and scope of the instant invention. As is shown in FIG. 5 (which shows the top of the left side rails of the ladder of FIG. 4) and 6 (a bottom side view of the ladder of FIG. 4), the guide rail from one section includes an intersection portion (I1-2, I2-3, I3-4) that curves over to and/or merges into the guide rail of the adjoining section of the ladder. The intersection portion allows the two adjoining guide rails to slide with respect to one another, such that the point of intersection changes as the ladder is extended and/or retracted. Referring specifically to FIGS. 5 and 6, I1-2 joins guide rail sections SG-R1 and SG-R2 together which are respectively located on extension sections E1 and E2 of the ladder; I2-3 joins guide rail sections SG-R2 and SG-R3 together which are respectively located on extension sections E2 and E3 of the ladder; I3-4 joins guide rail sections SG-R3 and SG-R4 together which are respectively located on extension sections E3 and E4 of the ladder. The guide rail and intersection portions work similar to a train track intersection routing a grab device from an outside rail to an inside rail (or vice versa) at the intersection portion. Also as is shown in FIG. 5, each guide rail includes a knob (SS) at the bottom of the rail to prevent a grab device from accidentally disengaging the rail. FIG. 7 shows a detailed view of an embodiment of the cross-sectional profile for the extruded solid body guide rails that is utilized in connection with the invention shown in FIG. 6. Nevertheless, it will be appreciated that the rail of the instant invention may include a solid extruded body, or a multiple section linkage (such as a chain) of virtually any cross-sectional profile to allow a grab device to glide along the rail.

Figures 8, 9:
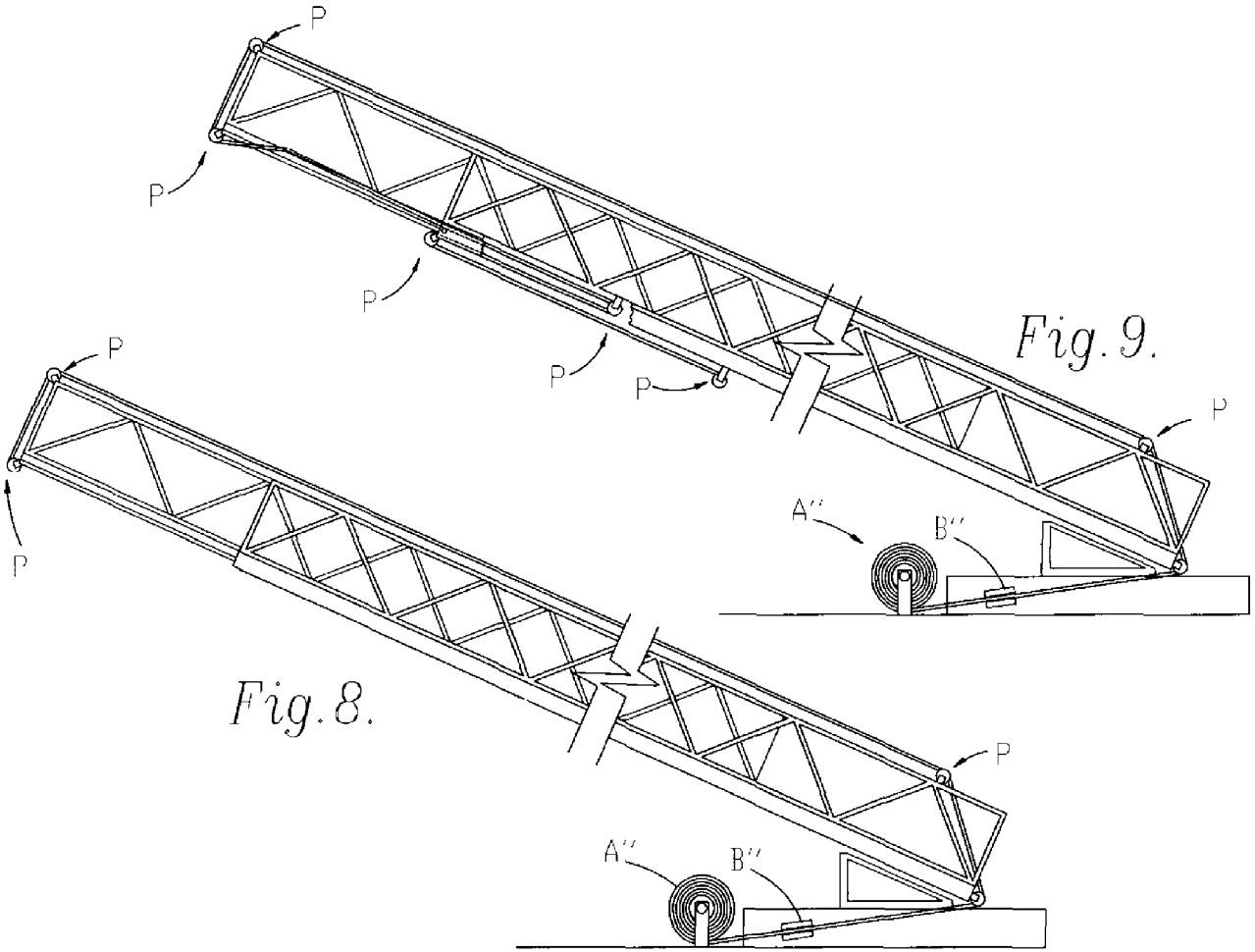
FIG. 8 is a side view of a telescoping/extension and/or aerial ladder including a ladder safety device of another embodiment of the instant invention.
FIG. 9 is a side view of a telescoping/extension and/or aerial ladder including a ladder safety device of another embodiment of the instant invention.

Referring to FIGS. 8 and 9, two embodiments of a combination spool and pulley system of the instant invention is shown. Referring to FIG. 8, a spool, A", is mounted on the underside of the ladder toward the bottom end of the lowest extension section of the ladder. A guide-wire extends from the spool below the underside of the lowest extension section, through brake mechanism B", around the bottom of that section and then upward along the top side of the extension sections and is routed through pulleys, mounts, or similar lead structures (referred to generally herein as "leads") P that are attached along the topside and underside of the ladder. In the embodiment shown in FIG. 8, the guide-wire terminates and/or is fixedly mounted at one end at a lead (P) on the underside of the top section of the ladder. Nevertheless, it will be appreciated that the location in which the guide-wire terminates may vary and may be on the top side, underside or along either side of the ladder, without departing from the spirit and scope of the instant invention. It will be appreciated In the embodiment shown in FIG. 8, the spool (A") is the primary storage mechanism for the guide-wire. In the embodiment shown in FIG. 9, pulleys (leads) P are utilized in a manner similar to that discussed above with respect to FIG. 3, such that the pulleys act as a storage mechanism for the guide-wire along the length of the ladder. In this embodiment, the spool (A") is utilized as another storage mechanism, but may be utilized to a lesser extent and, in a preferred embodiment is utilized primarily as a tensioning mechanism. The combination of the spool and pulley system allows a shorter length of guide-wire to be stored on the spool than in the embodiments that only utilized a spool, and potentially allows for increased reliability, better tensioning control, and increased flexibility in design and usage of the system. In one preferred embodiment, the pulley storage along the underside of the ladder is included on all extension sections of the ladder. Nevertheless, it will be appreciated that other embodiment may include the pulley wire storage on less that all extension sections. In such embodiment, the spool is relied upon for additional storage. It will be appreciated that the spool (A") utilized in connection with the embodiments shown in FIGS. 8 and 9 may include either an electrical or mechanical winding/unwinding mechanism of the type described in other embodiments herein, and may include any other winding/unwinding mechanism now known or hereafter discovered. Furthermore, it will be appreciated that spool A" may be mounted under the ladder, on the side of ladder at the bottom, on a platform or turntable, or at any other suitable location without departing from the spirit and scope of the instant invention. In will further be appreciated that although the guide-wire of FIGS. 8 and 9 both extend from the spool (A") around the bottom of the lowest extension section and then upward along the top side of the extension sections and back around to the underside of the ladder, the direction may be reversed without departing from the spirit and scope of the instant invention. Furthermore, it will be appreciated that in alternative embodiments, portions or all of the guide wire may extend along top side, underside, or either side of the ladder, or any combination thereof, without departing from the spirit and scope of the instant invention.

In the preferred embodiments in which a spool is utilized as a storage and/or tensioning mechanism, the guide-wire extends from a spool generally located toward the bottom of the ladder and extends upward along the front or side(s) of the ladder. In this manner the guide-wire is fixedly anchored toward the top of the ladder, such that a break mechanism is not necessarily required to support a load on the cable as the load is supported by the top anchor.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification and/or variations may be made in embodying the above invention, and in the construction thereof, other than those specifically set forth herein, may be achieved by those skilled in the art without departing from the spirit and scope of the invention, and that such changes, modification and/or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matters contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A ladder safety device, the ladder safety device comprising:

a spool configured to be disposed at a first end of an extendable ladder, the spool including a guide to which a fall protection harness is securable, the guide having a terminal end configured to be secured to a fixed-point mount at a second end of the extendable ladder; and a motor connected to the spool, the motor configured to respectively unwind and wind the guide from the spool in relation to the fixed-point mount to maintain tension on the guide as the extendable ladder is extended and retracted.

2. The ladder safety device as claimed in claim 1, wherein the guide is wound about the spool.

3. The ladder safety device as claimed in claim 2, wherein the guide comprises one of wire, cable, rope, strap and another material.

4. The ladder safety device as claimed in claim 1, further comprising a guide control system associated with the motor, the guide control system configured to control the motor to maintain tension on the guide based on a first output from a ladder control system that is associated with positioning the extendable ladder.

5. The ladder safety device as claimed in claim 1, further comprising a lead structure configured to be disposed at the first end of the extendable ladder and generally near the spool, the lead structure configured to redirect the guide from the spool to extend along a top of the extendable ladder.

6. The ladder safety device as claimed in claim 5, wherein the lead structure comprises a pulley.

7. The ladder safety device as claimed in claim 4, further comprising a brake associated with one of the motor and the spool.

8. The ladder safety device as claimed in claim 7, wherein the brake is associated with the guide control system, the guide control system further configured to activate the brake securing the guide based on a second output from the ladder control system indicating that the extendable ladder is extended or retracted to a desired position.

9. A ladder system comprising:

an extendable ladder having a first end and a second end, the second end including a fixed-point mount; and a ladder safety device associated with the extendable ladder, the ladder safety device comprising:

a spool configured to be disposed at the first end of the extendable ladder, the spool including a guide to which a fall protection harness is securable, the guide having a terminal end configured to be secured to the fixed-point mount at the second end of the extendable ladder; and a motor connected to the spool, the motor configured to respectively unwind and wind the guide from the spool in relation to the fixed-point mount to maintain tension on the guide as the extendable ladder is extended and retracted.

10. The ladder system as claimed in claim 9, wherein the guide is wound about the spool.

11. The ladder system as claimed in claim 10, wherein the guide comprises one of wire, cable, rope, strap and another material.

12. The ladder system as claimed in claim 9, wherein the ladder safety device further comprises a guide control system associated with the motor, the guide control system configured to control the motor to maintain tension on the guide based on a first output from a ladder control system that is associated with positioning the extendable ladder.

13. The ladder system as claimed in claim 9, wherein the ladder safety device further comprises a lead structure disposed at the first end of the extendable ladder and generally near the spool, the lead structure configured to redirect the guide from the spool to extend along a top of the extendable ladder.

14. The ladder system as claimed in claim 13, wherein the lead structure comprises a pulley.

15. The ladder system as claimed in claim 12, wherein the ladder safety device further comprises a brake associated with one of the motor and the spool.

16. The ladder system as claimed in claim 15, wherein the brake is associated with the guide control system, the guide control system further configured to activate the brake securing the guide based on a second output from the ladder control system indicating that the extendable ladder is extended or retracted to a desired position.

17. The ladder system as claimed in claim 9, further comprising a turntable configured to secure the first end of the extendable ladder.

18. The ladder system as claimed in claim 17, wherein the turntable is further configured to secure the ladder safety device.

* * * * *